United States Patent [19]

Scholz-Weigl et al.

[11] 3,993,605

[45] Nov. 23, 1976

[54] FOAM INHIBITED OR ATTENUATED WASHING, CLEANING AND RINSING AGENTS FOR DISHES AND UTENSILS

[75] Inventors: Sigrid Scholz-Weigl, Marl; Ferdinand von Praun, Lippramsford-Freiheit, both of Germany

[73] Assignee: Chemische Werke Huls Aktiengesellschaft

[22] Filed: June 2, 1975

[21] Appl. No.: 582,795

[30] Foreign Application Priority Data

June 5, 1974 Germany ..... 2427125

[52] U.S. Cl. ..... 252/550; 252/89 R; 252/135; 252/321; 252/358; 252/531; 252/532; 252/535; 252/536; 252/539; 252/540; 252/551; 252/554; 252/555; 252/558; 252/559

[51] Int. Cl.[2] ..... C11D 3/20; C11D 1/83

[58] Field of Search ..... 252/89, 135, 531, 532, 252/535, 536, 539, 550, 551, 554, 555, 558, 321, 358, 540, 559

[56] References Cited

UNITED STATES PATENTS

| | | | |
|---|---|---|---|
| 3,542,857 | 11/1970 | Lutz | 260/497 |
| 3,704,228 | 11/1972 | Eckert et al. | 252/110 X |
| 3,758,410 | 9/1973 | Liu | 252/135 X |

*Primary Examiner*—Harris A. Pitlick
*Attorney, Agent, or Firm*—Gilbert L. Wells

[57] ABSTRACT

Foam-controlled washing and cleaning and dishwashing composition, containing conventional detergents and additives, which are improved by the addition of about 20 – 70 percent by weight based on the total surfactant material of vicinal alkane diol mono and/or diesters of the formula

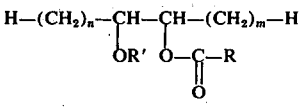

where R is hydrogen, linear or branched alkyl of 1 to 12 carbon atoms or phenyl; R′ is hydrogen or

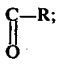

$n$ is zero or an integer from 1 to 28, $m$ is zero or an integer from 1 to 28 and where $n+m$ are integers from 10 to 30.

9 Claims, No Drawings

FOAM INHIBITED OR ATTENUATED WASHING, CLEANING AND RINSING AGENTS FOR DISHES AND UTENSILS

CROSS REFERENCE TO A RELATED APPLICATION

Applicants claim priority under 35 U.S.C. 119 for Application Ser. No. P 24 27 125.8, filed June 5, 1974, in the Patent Office of the Federal Republic of Germany.

BACKGROUND OF THE INVENTION

The field of the invention is surfactants and the present invention relates to foam controlling additives useful therein.

The state of the art of surfactants may be ascertained by reference to the Kirk-Othmer "Encyclopedia of Chemical Technology", 2nd Edition, Vol. 19 (1969), pp. 507–593 under the section "Surfactants", British Patent Nos. 808,945 and 802,302; German Published Patent Application Nos. 1,080,250; 2,015,435 and 2,043,087 and German Patent Nos. 1,056,316 and 1,257,338, the disclosures of which are incorporated herein.

Foam controlling or antifoaming additives are required in washing and cleaning agents for washing machines and automatic dishwashers to prevent excessive foam development and particularly to prevent the washing liquid from frothing over. There is a strong foaming tendency especially in those washing and cleaning agents containing active wash components of the sulfate or sulfonate type. These are precisely the active wash substances ordinarily used.

Not only is it important to avoid frothing over in the machines and hence a loss of washing agents as regards the problem of foam control of washing agents, but also large amounts of foam are undesirable because they interfere with the mechanical manipulation of the material to be cleaned, so that the washing and cleaning agents in the machines do not achieve their full cleaning potential.

It is furthermore desirable that besides effectively attenuating the foaming of a washing agent within a given temperature range, there also is a balanced foaming behavior over all of the range.

Washing agents are already known, which contain soap mixtures acting as foam regulators as disclosed in German Published Patent Application Nos. 1,080,250 and 2,015,435, and British Patent Nos. 802,302 and 808,945, and German Patent No. 1,056,316 and Chemical Abstracts, Vol. 74, page 238 35 T. Soaps indeed are good foam inhibitors but however their application also entails drawbacks, namely the washing liquid is always alkaline and moreover they tend to form lime soaps.

Furthermore, washing agents are already known which contain for instance such diamides as N,N'-distearoylethylenediamine, as disclosed in German Published Patent Application No. 2,043,087 and reported in Chemical Abstracts, Vol. 77, page 22020 Y, or melamine derivatives such as 2,4,6-tridodecylamino-s-triazine as disclosed in German Patent No. 1,257,338, as antifoaming agents. While these formulations form approximately no foam at the higher temperatures, foam formation is excessive at the middle and lower ones, so that there is no balanced foaming behaviour throughout the entire temperature range.

SUMMARY OF THE INVENTION

Having in mind the limitations of the prior art, it is an object of the present invention to provide a washing, cleaning and dishwashing composition containing conventional detergents and additives and characterized by containing mono and/or diesters of vicinal alkane diols of the formula

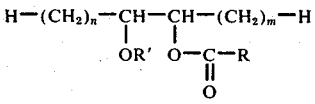

as foam controlling agent where R is hydrogen, a linear or branched alkyl group with 1 to 12 carbon atoms or a phenyl group; where R' is hydrogen or

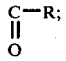

where $n$ is zero or an integer from 1 to 28; where $m$ is zero or an integer from 1 to 28; and where $n+m$ are integers from 10 to 30.

The washing composition contains from 20 to 70 percent by weight of mono or diesters of vicinal alkane diols based on the total surfactant material.

Preferably the washing composition contains from 30 to 55 percent by weight of mono or diesters of vicinal alkane diols based on the total surfactant material.

The washing, cleaning and dishwashing compositions of the present invention comprise the following ingredients:

A.

5 – 35 percent by weight of anionic detergents selected from the group consisting of alkylbenzene sulfonates, alkane sulfonates, olefin sulfonates, fatty alcohol sulfates, fatty alcohol polyethoxysulfates, carboxylates of oxethylated alcohols, sulfosuccinates 0 – 20 percent by weight of nonionic detergents, selected from the group consisting of oxethylates of long-chain alcohols, alkylphenol oxethylates, oxethylated fatty acids, oxethylated fatty acid amides, ethylene oxide/propylene oxide copolymers 5 – 70 percent by weight of a builder, selected from the group consisting of alkali salts of phosphates, e.g. alkali tripolyphosphate, alkali nitrilo triacetate, alkali citrate 0 – 50 percent by weight of inorganic salts selected from the group consisting of sodium perborate, sodium sulfate, sodium carbonate, sodium silicate, magnesium silicate

B.

20 – 70 percent by weight based on the total surfactant material of monoesters and/or diesters of vicinal alkanediols as foam controlling agent.

DESCRIPTION OF THE PREFERRED EMBODIMENT

The mono or diesters of vicinal alkane diols of the present invention are as described in L. F. Fieser and M. Fieser, Advanced Organic Chemistry 160 (1961), Reinhold Publishing Corporation or in D. Swern, Org.

Reac. VII, 382 (1953) and as disclosed in U.S. Pat. No. 3,542,857, which issued Nov. 24, 1970. For instance, linear aliphatic olefins with internal double bonds are made into epoxides by epoxidation with organic hydroperoxides or with peracids or with hydrogen peroxide and carboxylic acids which form peracids. Immediately upon epoxidation, these epoxides are reacted with the carboxylic acid present in the reaction mixture, or, following isolation, with another carboxylic acid. Depending on the excess of one or the other of the reaction partners, one obtains monoesters, diesters or a mixture of both. Starting with such olefins, where the double bond is distributed randomly over the chain of carbon atoms, one obtains ester mixtures of diols randomly distributed over the chain of carbon atoms. Esterification of vicinal diols is another production method.

The preparation of the vicinal hydroxyacyloxyalkanes and vicinal diacyloxyalkanes raw materials of the present invention are explained by means of the following examples:

To 120 gm of 30 percent hydrogen peroxide at 30° to 35° C, one adds dropwise within 5 hours 540 gm of acetic anhydride containing 5.4 gm of concentrated sulfuric acid and this mixture is let to stand at room temperature overnight. 9.3 gm of sodium acetate is added to the 14 to 16 percent peracetic acid formed and this is dripped within 5 hours at 30° to 35° C to 336 gm (1.5 mole) of mid-position hexadecene and stirred thereafter at 35° C until the content of peracetic acid falls below 1 percent (iodometric titration).

1. vicinal hexadecanediol monoacetic acid ester;

Following addition of solid sodium bisulfite to remove residual peroxide compounds, the solution is heated to 100° C and stirred for several hours until the epoxy content drops below 1 percent (titration with HBr in glacial acetic acid against crystal violet). Subsequently, the components of low boiling points are distilled off at atmospheric pressure, while the high boiling point fractions are distilled off under oil pump vacuum. Vicinal hexadecanediol monoacetic acid ester following a first running of non-converted hexadecene boils at 138° to 142° C at 0.2 torr: ($n_D^{20} = 1.4476$).

2. isolation of epoxy hexadecane and conversion with formic acid:

The reaction product from peracetic acid and mid-position hexadecene is reacted with 250 ml of 8 percent sodium bisulfite solution and the lower phase is separated. The upper phase is washed again three times with bisulfite solution, solid sodium hydrogen carbonate is added, and, following separation of the bicarbonate, the product is dried by means of sodium sulfate. Subsequently, with addition of 100 gm of high boiling point paraffin oil, it is distilled. Following a first running containing hexadecene, the epoxy hexadecane boils at 100° C at 0.1 torr: $n_D^{20} = 1.4419$. Crude yield = 318 gm comprising 72 percent of epoxide; after distillation: 190 gm of epoxy hexadecane.

When 60 gm (0.25 mole) of epoxy hexedecane are added dropwise to 11.5 gm (0.25 mole) of formic acid, the temperature rises the exothermic reaction to 70° C. Stirring is carried on until the epoxy content falls below 1 percent, whereupon one distills. The yield is 58 gm of vicinal hexadecanediol formic acid ester (boiling point 145° C at 0.2 torr) as a semisolid substance.

When this reaction is repeated with excess formic acid, one obtains, depending on the time of reaction, mixtures of mono and diesters or the diester in pure form. Following 2 hours' stirring at 50° to 60° C and standing overnight, one obtains a product boiling at 137° – 145° C at 0.1 torr which, according to the OH number, saponification number and infra-red analysis, contains 80 percent diester.

Reaction of the epoxy alkanes with other carboxylic acid takes place similarly, appreciably longer reaction times being required as a rule.

Example of linear olefins to be used as starting materials for the production of the mono and diester of vicinal alkanediols are dodecene, tridecene, tetradecene, hexadecene, octadecene, eicosene, docosene, tetracosene, hexacosene and so on. However, economic reasons preclude starting from individual components, rather one begins with alpha-olefin mixtures that are isomerized by known measures to mid-position olefins. The double bonds in the olefins are randomly distributed over the entire molecule.

In order to esterify the epoxides first obtained in the preparation, one may use the following: formic acid, acetic acid, propionic acid, butyric acid, valeric acid, caproic acid, caprylic acid, 2-ethylhexanoic acid, capric acid, lauric acid, benzoic acid.

Monoesters of vicinal alkanediols that are used in conformity with the present invention in washing, cleaning and dishwashing compositions include, but are not limited to: vicinal dodecanediol monoformic acid ester; vicinal tetradecanediol monoformic acid ester; vicinal hexadecanediol monoformic acid ester; vicinal octadecanediol monoformic acid ester; vicinal eicosanediol monoformic acid ester; vicinal docosanediol monoformic acid ester; vicinal tetracosanediol monoformic acid ester; vicinal pentacosanediol monoformic acid ester; vicinal triacontanediol monoformic acid ester; vicinal dodecanediol monoacetic acid ester; vicinal tetracanediol monoacetic acid ester; vicinal hexadecanediol monoacetic acid ester; vicinal octadecanediol monoacetic acid; vicinal eicosanediol monoacetic acid; vicinal docosanediol monoacetic acid ester; vicinal tetracosanediol monoacetic acid ester; and vicinal pentacosanediol monoacetic acid ester. Similarly, the corresponding esters of propionic acid, butyric acid, valeric acid, isovaleric acid, caproic acid, caprylic acid, 2-ethylhexanoic acid, capric acid, lauric acid, benzoic acid are useful.

Since olefin chains of various C numbers are used as a rule as raw materials for the preparation of the esters of the vicinal diols and since esters of vicinal diol mixtures also of various C numbers are obtained therefrom, such mixtures generally are used.

The washing agents of the present invention may, for instance, contain the following as diesters of vicinal alkane diols: vicinal dodecanediol diformic acid ester; vicinal tetradecanediol diformic acid ester; vicinal octadecanediol diformic acid ester; vicinal eicosanediol diformic acid ester; vicinal docosanediol diformic acid ester; vicinal tetracosanediol diformic acid ester; vicinal hexacosanediol diformic acid ester, etc.

Similarly, the corresponding diesters of acetic, propionic, butyric, valeric, isovaleric, caproic, 2-ethylhexanoic, capric, laurie and benzoic acids are used.

Since generally olefin chains of various C numbers are used for the preparation of the esters of vicinal diols, and since the esters of vicinal diol mixtures also are of various C numbers, one as a rule makes use of such mixtures.

Conventional anionic and nonionic compounds are contained as active surfactants in the washing, cleaning and dishwashing compositions of the present invention. For instance, alkane sulfonates, olefin sulfonates, alkylbenzol sulfonates, fatty alcohol sulfates, fatty alcohol polyethoxysulfates, oxethylates of long chain alcohols, alkylphenol oxethylates and carboxylates of oxethylated alcohols are suitable. The washing and cleaning formulation furthermore may contain conventional additives such as phosphates, silicates, carbonate, cellulose derivatives, etc.

The present invention is further illustrated by the following more detailed examples thereof.

EXAMPLES 1 through 17

The whipping method of DIN (German Industrial-Standard) No. 53,902 was carried out using the whipping equipment of Eberhardt & Leimer to measure the foam inhibiting characteristics of Examples 1 through 17. One gram of surfactant (alkylbenzol sulfonate sodium salt) and 0.3 gm of testing material were dissolved in 1 liter of water (12° German hardness), adjusted to a pH of 8 to 9 and measured at 20°, 40°, 60°, 80° C. When the volume of foam obtained 30 seconds after foaming is less than 200 ml, one considers the result as being good, and as being very good if the volume is less than 100 ml.

The results are shown in Table 1 which follows.

EXAMPLES 18 and 19

The foam inhibiting effect on alpha-olefin sulfonates by the whipping method of DIN 53,902 is tested in he same manner as for Examples 1 through 17. The test solution containing 1 gm of $C_{14-18}$-alpha-olefin-sulfonate-sodium-salt and 0.3 gm of test material in one liter of water (12° dH) and being set for a pH of 8 to 9. The foam volume measured 30 seconds after foaming for vicinal hexadecanediol monoformic acid ester (R=H, $n+m$32 14) was 35 ml at 20° C, 50 ml at 40° C, 75 ml at 60° C, and 160 ml at 80° C; for vicinal $C_{22-28}$-alkanediol monoformic acid ester (R=H, $n+m$ = 20/22/24/26), it was 40 ml at 20° C, 55 ml at 40° C, 112 ml at 60° C and 80 ml at 80° C. In comparison, when Talgolit soap is used as the test material, the foam volumes are 60 ml at 20° C, 85 ml at 40° C, 115 ml at 60° C, and 140 ml at 80° C.

EXAMPLES 20 and 21

The test is performed per DIN No. 53,902 in the presence of 1 gm/liter of sodium salt of a carboxymethylated $C_{12-14}$ alcohol oxethylate with 4.5 moles of ethylene oxide as the surfactant. When adding 0.3 gm/liter of test material, very low foam volumes are also obtained. The values for vicinal hexadecanediol monoformic acid ester (R=H, $n+m$=14) are 30 ml at 20° C, 20 ml at 40° C, 20 ml at 60° C and 45 ml at 80° C. Regarding the ester mixture of 80 percent vicinal hexadecanediol diformic acid ester and 20 percent vicinal hexadecanediol monoformic acid ester, the foam volumes are 20 ml at 20° C, 20 ml at 40° C, 25 ml at 60° C and 45 ml at 80° C.

When using Talgolit soap for comparison, one obtains 70 ml at 20° C, 85 ml at 40° C, 80 ml at 60° C and 100 ml at 80° C.

TABLE 1

| | Whipping Method per DIN 53,902 | | | | | | | | |
|---|---|---|---|---|---|---|---|---|---|
| | Example No. | n + m | R | Mono-ester [%] | Di-ester [%] | foam volume [ml] 1 g/l Alkylbenzol-sulfonate 20° | 40° | 60° | 80° |
| per invention | 1 | 14 | H | 100 | — | 28 | 18 | 23 | 28 |
| " | 2 | 14 | H | 20 | 80 | 27 | 25 | 25 | 25 |
| " | 3 | 14 | $CH_3$ | 100 | — | 27 | 28 | 41 | 60 |
| " | 4 | 14 | $C_2H_5$ | 100 | — | 25 | 20 | 28 | 30 |
| " | 5 | 14 | $C_3H_7$ | 100 | — | 25 | 20 | 28 | 32 |
| " | 6 | 14 | $CH(C_4H_9)(C_2H_5)$ | 100 | — | 35 | 40 | 40 | 40 |
| " | 7 | 14 | $C_{11}H_{23}$ | 90 | 10 | 30 | 35 | 30 | 32 |
| " | 8 | 14 | 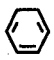 | 100 | — | 35 | 30 | 35 | 32 |
| " | 9 | 10/11 | H | 100 | — | 40 | 50 | 82 | 85 |
| " | 10 | 10 | H | — | 100 | 32 | 42 | 55 | 100 |
| comparison | 11 | 8/9 | H | 100 | — | 30 | 45 | 75 | 190 |
| " | 12 | 8/9 | $CH_3$ | 100 | — | 65 | 105 | 230 | 400 |
| " | 13 | 4+4 | H | 95 | 5 | 125 | 150 | 200 | 295 |
| " | 14 | 4+4 | $CH_3$ | 100 | — | 85 | 85 | 110 | 224 |
| per invention | 15 | 10+10 | $CH_3$ | 25 | 75 | 36 | 41 | 62 | 75 |
| " | 16 | 20/22/24/26 | H | 100 | — | 23 | 25 | 30 | 30 |
| " | 17 | 20/22/24/26 | $CH_3$ | 90 | 10 | 41 | 40 | 61 | 70 |
| comparison | 0.3 g/l | Talgolit soap + | | | | 110 | 145 | 240 | 275 |
| | | behenic acid, Na salt | | | | 135 | 180 | 240 | 320 |
| | | palmitic acid, Na salt | | | | 140 | 120 | 130 | 420 |

+ mixture of the sodium salts of palmitic acid and stearic acid with iodine number 1–3

As can be seen from Table 1, the mono or diesters of vicinal diols evidence an excellent foam inhibiting effect in the washing and cleaning agents of the present invention with respect to the most frequently used detergents, i.e., alkylbenzol sulfonates. They even surpass the soaps and mixtures thereof which are known for their foam inhibiting characteristics in their foam inhibiting action on alkylbenzol sulfonate.

EXAMPLES 22 through 25

The foaming behavior of a washing agent is tested in Examples 22 through 25 in a commercial, fully automatic washing machine with a horizontally supported drum as a function of the temperature of the liquid. The round viewing glass of the washing machine allows observing the foam level and is divided into 20 scale graduations corresponding to a diameter of 20 cm. The following "grades" are given to evaluate the height of the foam:

| | |
|---|---|
| 0 – 5 cm: | 1 |
| 6 –10 cm: | 2 |
| 11–15 cm: | 3 |
| 16–20 cm: | 4 |
| filled with foam: | 5 |
| overflowing with foam: | 6 |

The washing machine is loaded with 1 kg of clean cotton laundry. The concentration of the washing agent is 5 gm/liter (12° German hardness); the weight ratio of textiles to washing liquid is 1 to 15. In the absence of a foam inhibitor, the machine fills with foam in the temperature range from 30 to 80° C. When boiling (90° – 95° C), the foam overflows.

The washing agent used in the test is of the following composition:

5.8 parts of alkylbenzol sulfonate
3.9 parts of $C_{16-18}$ fatty alcohol + 25 moles of ethylene oxide
39.2 parts of sodium triphosphate, $Na_5P_3O_{10}$
25.4 parts of sodium perborate-tetrahydrate, $NaBO_2.H_2O_2.3H_2O$
23.6 parts of sodium sulfate decahydrate, $Na_2SO_4 10H_2O$
0.5 parts of sodium chloride, NaCl
0.8 parts of sodium carbonate, $Na_2CO_3$
4.6 parts magnesium silicate, $Mg(SiO_2)_{3.5}$
0.2 parts of optical brighteners
1.0 part of carboxymethyl cellulose.

The compositions containing mixtures of 5- and 6-N,N'-distearoylethylenediamine and 2,4,6-tridodecylamino-s-triazine, while free from such drawbacks, however suffer from most unsatisfactory foaming behavior in the lower or middle temperature ranges. On the other hand, the agents of the present invention evidence a balanced foaming behavior throughout the entire temperature range.

EXAMPLE 30

The foaming behavior of the composition below is tested in a fully automatic washing machine in the same manner as in Examples 22 through 25:

11.5 parts of $C_{14-18}$ alpha olefin sulfonate
60.0 parts of sodium salt of a sulfonated polybutadiene(molecular weight 1500)
5.5 parts of magnesium silicate
1.0 part of sodium cumene sulfonate
17.8 parts of sodium perborate-tetrahydrate
0.2 parts of optical brightener
2.5 parts of foam inhibitor.

In the absence of foam inhibitor, the machine fills with foam at 30° C (grade 5). When adding 2.5 parts of vicinal hydroxyacetoxyhexadecane ($R = CH_3$; $n + m = 14$), the foam values fall between 0 and 5 (grade 1) for the entire temperature range (30°, 60°, 80°, 95° C).

We claim:

1. A foam controlled washing and cleaning composition or dishwashing composition consisting essentially of A.
5 – 35 percent by weight of anionic detergents
0 – 20 percent by weight of nononic detergents
5 – 70 percent by weight of builders B.
20 – 70 percent by weight based on said anionic and nonionic detergents of a vicinal alkanediol monoester and/or diester of the formula:

TABLE 2

| | Example No. | n+m | Washing Machine Test R | Test substance content in % | foam "grade" 20° | 60° | 80° | 95° |
|---|---|---|---|---|---|---|---|---|
| per invention | 22 | 14 | $CH_3$ | 2.5 | 3 | 3 | 2 | 1 |
| | | | | 5 | 1 | 1 | 1 | 1 |
| " | 23 | 14 | $C_2H_5$ | 2.5 | 2 | 3 | 3 | 1 |
| | | | | 5 | 1 | 1 | 1 | 1 |
| " | 24 | 14 | $C_3H_7$ | 5 | 1 | 3 | 3 | 1 |
| " | 25 | 14 | $CH(C_4H_9)(C_2H_5)$ | 2.5 | 1 | 2 | 2 | 1 |
| | | | | 5 | 1 | 2 | 1 | 1 |
| comparison | 26 | N,N'-Distearoyl ethylenediamine | | 2.5 | 3 | 4 | 2 | 1 |
| | | | | 5 | 3 | 4 | 1 | 1 |
| " | 27 | 2,4,6-Tridodecyl-amino-s-triazine | | 2.5 | 5 | 3 | 1 | 1 |
| | | | | 5 | 5 | 2 | 1 | 1 |
| " | 28 | sodium behenate | | 2.5 | 5 | 6 | — | — |
| " | 29 | Talgolit soap | | 5 | 1 | 1 | 1 | 1 |

Table 2 shows that excellent foam "grades" are obtained when a composition contains Talgolit soap. As already mentioned initially, soaps contained in washing liquids entail the drawback of alkalinity and lime-soap formation.

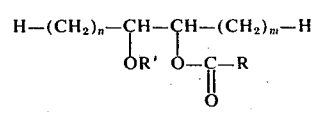

as foam controlling agent, where R is hydrogen, linear or branched alkyl of one to twelve carbon atoms or phenyl; R′ is hydrogen or $$-\underset{\underset{O}{\|}}{C}-R;$$

$n$ is zero or an integer from 1 to 28;
$m$ is zero or an integer from 1 to 28; and
$n + m$ is an integer from 10 to 30.

2. The compositions of claim 1, wherein said foam controlling agents comprise about 30 to 55 percent by weight based on total detergent material.

3. The compositions of claim 1, wherein said esters of vicinal alkane diols are selected from the group consisting of vicinal hexadecanediol monoformic acid ester; vininal octadecanediol monoformic acid ester; vicinal eicosanediol monoformic acid ester; vicinal docosanediol monoformic acid ester; vicinal tetracosanediol monoformic acid ester; vicinal hexacosanediol monoformic acid ester; vicinal triacontanediol monoformic acid ester; vicinal hexadecanediol monoacetic acid ester; vicinal octadecanediol monoacetic acid ester; vicinal eicosanediol monoacetic acid ester; vicinal docosanediol monoacetic acid ester; vicinal tetracosanediol monoacetic acid ester; vicinal hexacosanediol monoacetic acid ester; vicinal hexadecanediol diformic acid ester; vicinal octadecanediol diformic acid ester; vicinal aicosanediol diformic acid ester; vicinal docosanediol diformic acid ester; vicinal tetracosanediol diformic acid ester; vicinal hexacosanediol diformic acid ester, and vicinal triacontanediol diformic acid ester.

4. A composition according to claim 1, wherein a mixture of isomeric vicinal alkanediol monoesters and/or diesters is used in which the ester groups are randomly distributed over the carbon chain.

5. A composition according to claim 4, wherein the vicinal alkanediol esters have been esterified with formic acid, acetic acid, propionic acid, butyric acid, valeric acid, isovaleric acid, caproic acid, caprylic acid, 2-ethylhexanoic acid, capric acid, lauric acid or benzoic acid.

6. A composition according to claim 1, wherein the detergent material is a sulphonate or sulphate detergent.

7. A composition according to claim 1, wherein said foam controlling agent is selected from the group consisting of mixtures of $C_{14}/C_{16}/C_{18}/C_{20}$ alkanediol monoesters of formic acid,
$C_{14}/C_{16}/C_{18}/C_{20}$ alkanediol diesters of formic acid,
$C_{22}/C_{24}/C_{26}/C_{28}$ alkanediol monoesters of formic acid,
$C_{22}/C_{24}/C_{26}/C_{28}$ alkanediol diesters of formic acid,
$C_{14}/C_{16}/C_{18}/C_{20}$ alkanediol monoesters of acetic acid,
$C_{14}/C_{16}/C_{18}/C_{20}$ alkanediol diesters of acetic acid,
$C_{22}/C_{24}/C_{26}/C_{28}$ alkanediol monoesters of acetic acid,
$C_{22}/C_{24}/C_{26}/C_{28}$ alkanediol diesters of acetic acid,
$C_{14}/C_{16}/C_{18}/C_{20}$ alkanediol monoesters of propionic acid,
$C_{14}/C_{16}/C_{18}/C_{20}$ alkanediol diesters of propionic acid,
$C_{22}/C_{24}/C_{26}/C_{28}$ alkanediol monoesters of propionic acid,
$C_{22}/C_{24}/C_{26}/C_{28}$ alkanediol diesters of propionic acid,
$C_{14}/C_{16}/C_{18}/C_{20}$ alkanediol monoesters of butyric acid,
$C_{14}/C_{16}/C_{18}C_{20}$ alkanediol diesters of butyric acid,
$C_{22}/C_{24}/C_{26}/C_{28}$ alkanediol monoesters of butyric acid,
$C_{22}/C_{24}/C_{26}/C_{28}$ alkanediol diesters of butyric acid,
$C_{14}/C_{16}/C_{18}/C_{20}$ alkanediol monoesters of valeric acid,
$C_{14}/C_{16}/C_{18}/C_{20}$ alkanediol diesters of valeric acid,
$C_{22}/C_{24}/C_{26}/C_{28}$ alkanediol monoesters of valeric acid,
$C_{22}/C_{24}/C_{26}/C_{28}$ alkanediol diesters of valeric acid,
$C_{14}/C_{16}/C_{18}/C_{20}$ alkanediol monoesters of isovaleric acid,
$C_{14}/C_{16}/C_{18}/C_{20}$ alkanediol diesters of isovaleric acid,
$C_{22}/C_{24}/C_{26}/C_{28}$ alkanediol monoesters of isovaleric acid,
$C_{22}/C_{24}/C_{26}/C_{28}$ alkanediol diesters of isovaleric acid,
$C_{14}/C_{16}/C_{18}/C_{20}$ alkanediol monoesters of caproic acid,
$C_{14}/C_{16}/C_{18}/C_{20}$ alkanediol diesters of caproic acid,
$C_{22}/C_{24}/C_{26}/C_{28}$ alkanediol monoesters of caproic acid,
$C_{22}/C_{24}/C_{26}/C_{28}$ alkanediol diesters of caproic acid,
$C_{14}/C_{16}/C_{18}/C_{20}$ alkanediol monoesters of caprylic acid,
$C_{14}/C_{16}/C_{18}/C_{20}$ alkanediol diesters of caprylic acid,
$C_{22}/C_{24}/C_{26}/C_{28}$ alkanediol monoesters of caprylic acid,
$C_{22}/C_{24}/C_{26}/C_{28}$ alkanediol diesters of caprylic acid,
$C_{14}/C_{16}/C_{18}/C_{20}$ alkanediol monoesters of 2-ethylhexanoic acid,
$C_{14}/C_{16}/C_{18}/C_{20}$ alkanediol diesters of 2-ethylhexanoic acid,
$C_{22}/C_{24}/C_{26}/C_{28}$ alkanediol monoesters of 2-ethylhexanoic acid,
$C_{22}/C_{24}/C_{26}/C_{28}$ alkanediol diesters of 2-ethylhexanoic acid,
$C_{14}/C_{16}/C_{18}/C_{20}$ alkanediol monoesters of capric acid,
$C_{14}/C_{16}/C_{18}/C_{20}$ alkanediol diesters of capric acid,
$C_{22}/C_{24}/C_{26}/C_{28}$ alkanediol monoesters of capric acid,
$C_{22}/C_{24}/C_{26}/C_{28}$ alkanediol diesters of capric acid,
$C_{14}/C_{16}/C_{18}/C_{20}$ alkanediol monoesters of lauric acid,
$C_{14}/C_{16}/C_{18}/C_{20}$ alkanediol diesters of lauric acid,
$C_{22}/C_{24}/C_{26}/C_{28}$ alkanediol monoesters of lauric acid,
$C_{22}/C_{24}/C_{26}/C_{28}$ alkanediol diesters of lauric acid,
$C_{14}/C_{16}/C_{18}/C_{20}$ alkanediol monoesters of benzoic acid,
$C_{14}/C_{16}/C_{18}/C_{20}$ alkanediol diesters of benzoic acid,
$C_{22}/C_{24}/C_{26}/C_{28}$ alkanediol monoesters of benzoic acid and
$C_{22}/C_{24}/C_{26}/C_{28}$ alkanediol diesters of benzoic acid.

8. An improvement in the method of laundering comprising preparing an aqueous solution with the composition of claim 1 and laundering with said solution.

9. An improvement in the method of washing dishes comprising preparing an aqueous solution with the composition of claim 1 and washing dishes with said solution.

* * * * *